US005640168A

United States Patent [19]

Heger et al.

[11] Patent Number: 5,640,168

[45] Date of Patent: Jun. 17, 1997

[54] ULTRA WIDE-BAND RADAR ANTENNA FOR CONCRETE PENETRATION

[75] Inventors: Charles E. Heger, Saratoga; James C. Long, Sunnyvale; Noel H. C. Marshall, Woodside, all of Calif.

[73] Assignee: Zircon Corporation, Campbell, Calif.

[21] Appl. No.: 522,818

[22] Filed: Aug. 11, 1995

[51] Int. Cl.[6] ..... H01Q 13/00

[52] U.S. Cl. ..... 343/786; 343/776; 343/785

[58] Field of Search ..... 343/785, 786, 343/776

[56] References Cited

U.S. PATENT DOCUMENTS

| | | | |
|---|---|---|---|
| 3,389,394 | 6/1968 | Lewis | 343/786 |
| 3,414,903 | 12/1968 | Bartlett et al. | 343/786 |
| 3,482,251 | 12/1969 | Bowes | 343/785 |
| 3,611,396 | 10/1971 | Jones | 343/786 X |

*Primary Examiner*—Donald T. Hajec
*Assistant Examiner*—Tho Phan
*Attorney, Agent, or Firm*—Skjerven, Morrill, MacPherson, Franklin & Friel; Arthur J. Behiel

[57] ABSTRACT

A pyramidal horn antenna that decreases ringing in radar systems that are placed against a solid volume of e.g. concrete or wood for finding an object in or behind the solid volume. The antenna includes a solid, pyramid-shaped dielectric, the pyramid shape including a rectangular base and four triangular sides that extend from the base to meet at the apex of the pyramid. Two conductive triangular plates overlay opposite ones of the four sides of the pyramid, each of the plates including an electrical connection for coupling the plate to a radar system. The pyramid-shaped dielectric has a dielectric constant that approximates the dielectric constant of the solid volume, and therefore provides an impedance match between the antenna and the solid volume.

13 Claims, 2 Drawing Sheets

ULTRA WIDE-BAND RADAR ANTENNA FOR CONCRETE PENETRATION

CROSS-REFERENCE TO RELATED APPLICATIONS

The present application is related to application Ser. No. 08/300.279, filed on Sep. 2, 1994, entitled "Swept Range Gate Radar System for Detection of Nearby Objects," Charles E. Heger, and to application Ser. No. 08/514205, filed on Aug. 11, 1995, entitled "Dual Transmitter Visual Display System," Charles E. Heger, James C. Long, Noel H. C. Marshall, and Paul W. Dodd, both of which applications are incorporated herein by this reference.

BACKGROUND OF THE INVENTION

1. Field of the Invention

This invention relates to radar systems, and more specifically to an improved antenna for use with short-range radar systems for locating reinforcing steel rods, pipes, and other nearby objects positioned behind or within a volume of, e.g., concrete, soil, or wood.

2. Description of Related Art

A requirement exists for a cost-effective system capable of precisely locating objects, such as reinforcing steel rods (rebar), pipes, and air bubbles, behind or within a volume of, for example, concrete, soil, or wood. Various devices and systems currently exist to locate these various objects, but all are either expensive or of limited capability.

To overcome disadvantages of other available systems, Zircon Corporation of Campbell, Calif., developed an improved radar system for locating, e.g., buried objects. This radar system is described in the U.S. Patent Application entitled "Swept Range Gate Radar System for Detection of Nearby Objects," which has been incorporated herein by reference.

The radar system described in that application transmits a pulse and senses a return echo. The radar system then provides indications of (1) the strength of the return echo, and (2) the time lapse between transmitting the pulse and receiving the return echo. The strength of the return echo provides an indication of the size and material of the object reflecting the signal, while the time lapse provides an indication of the distance (i.e., range) between the system and the object.

Such a radar system can make use of any of several conventional antennas, including monopole and pyramidal designs. One such antenna, a conventional two-sided pyramidal horn 10, is shown in FIG. 1. Horn 10 includes two conductive triangular plates 12A and 12B that diverge to form two sides of a pyramid. Triangular plates 12A and 12B are formed of a conductive material, such as aluminum, and are held in place with respect to one another by non-conductive members, for example, plexiglass rods 14A and 14B.

The monopole antenna described in the application entitled "Swept Range Gate Radar System for Detection of Nearby Objects" and the pyramid antenna 10 of FIG. 1 share several shortcomings. For example, when either one of these antennas is used to transmit energy into, or receive energy from, a solid volume of e.g. concrete, the impedance mismatch between the antenna and the volume of material results in potentially severe ringing and re-reflection of the pulse energy at the antenna/concrete boundary. This ringing, or "first surface effect," wastes power and limits the minimum usable range of antenna 10 because the ringing masks return echoes that occur within the ringing period. Therefore, an improved antenna that decreases the first surface effect is needed.

SUMMARY

The present invention is directed to a pyramidal horn antenna that evinces a decreased first surface effect when placed against a solid volume of e.g. concrete or wood.

An antenna in accordance with the present invention includes a pyramid formed of a solid dielectric material, the pyramid including a rectangular base and four triangular sides that extend from the base to meet at the apex of the pyramid. Two conductive triangular plates overlay opposite ones of the four sides of the pyramid, each of the plates including an electrical connection for coupling the plate to a radar system.

In accordance with the invention, the dielectric material of the pyramid has a dielectric constant that approximtes the dielectric constant of the solid volume, and therefore provides an impedance match between the antenna and the material of the solid volume.

DETAILED DESCRIPTION

One antenna in accordance with the present invention is used in conjunction with a radar system that uses very short broadband electromagnetic pulses (typically 100 picoseconds in duration) to penetrate some solid material, such as concrete. Some portion of the transmitted pulse energy is reflected back to the system by structures in or behind the concrete that have a substantially different dielectric constant than does concrete.

To effectively perform this task, the present inventors have determined that transmit and receive antennas in accordance with the invention should satisfy the following criteria:

1. they should be broad-band to provide little distortion to the narrow transmit pulse and the resulting echo;
2. they should have a degree of directivity to both maximize the available power and narrow the field of illumination; and
3. they should effectively match the radiating impedance of the antenna with the concrete material.

Figure 1:
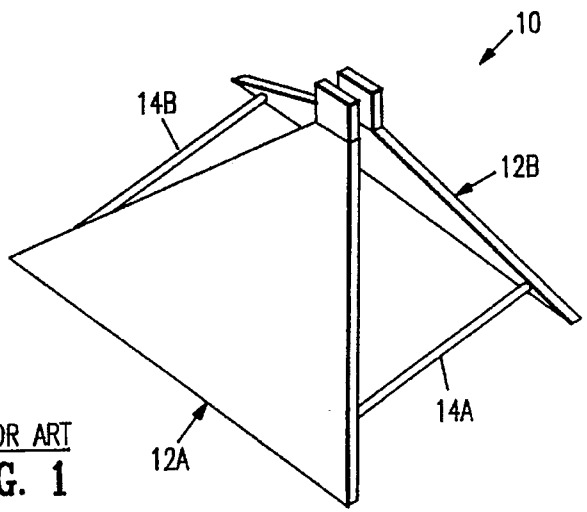
PRIOR ART FIG. 1
FIG. 1 shows a conventional two-sided pyramidal horn antenna.

The conventional two-sided pyramidal horn antenna 10 of FIG. 1 satisfies the first two of these requirements. However, as discussed above, this antenna 10 of FIG. 1 does not satisfy the third requirement because that antenna does not provide effective impedance matching.

Figure 2:
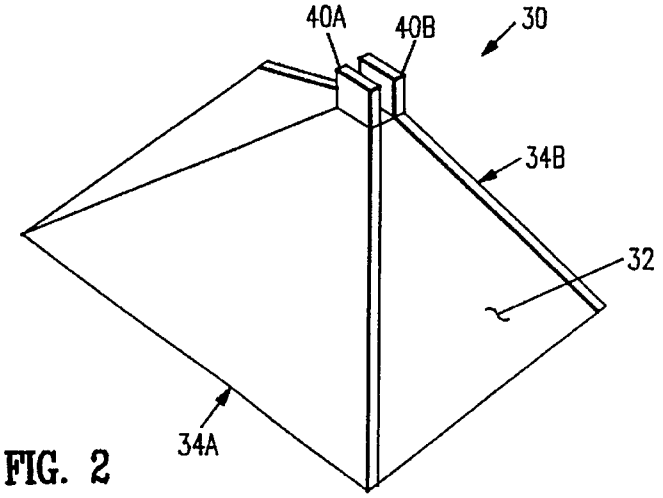
FIG. 2 shows an antenna 30 in accordance with the present invention.

FIG. 2 shows an antenna 30 in accordance with the present invention that meets all three of the required criteria. Antenna 30 includes a pyramid-shaped block 32 formed of a dielectric material having a dielectric constant $\epsilon_R$ approximately equal to that of concrete (e.g., $\epsilon_R \approx 10$) for use in finding objects in or behind concrete.

Two opposite sides of antenna 30 are overlayed with sheets of conductive material, such as aluminum, copper, or a silver alloy, to form triangular antenna plates 34A and 34B. Triangular antenna plates 34A and 34B form a tapered transmission line that expands in both width and separation from the apex of antenna 30.

Antenna 30 includes tabs 40A and 40B coupled to triangular antenna plates 34A and 34B, respectively. Tabs 40A and 40B are differentially connected to either (1) an excitation source if antenna 30 is for a transmitter, or (2) an amplifier or other receive circuitry if antenna 30 is for a receiver. (In this situation, separate transmit and receive antennas are typically provided.)

Figure 3B:
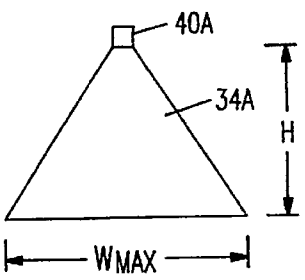
FIGS. 3A and 3B are side views of antenna 30.
Figure 3A:
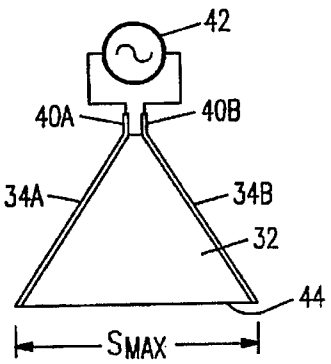

FIGS. 3A and 3B are side views of antenna 30. In FIG. 3A, triangular antenna plates 34A and 34B are differentially connected to an excitation source 42 via tabs 40A and 40B. In one embodiment of the invention, the maximum separation $S_{MAX}$ of triangular antenna plates 34A and 34B is approximately 1.5 inches, the maximum width $W_{MAX}$ of triangular plates 34A and 34B is approximately 1.75 inches, and the height H of antenna 30 is approximately 1.5 inches. With these dimensions, antenna 30 has an approximate bandwidth of from 0.8 to 10 GHz. These dimensions are not limiting and are not critical.

To image internal structures in, for example, a concrete wall, the base 44 of antenna 30 (see FIG. 3A) is placed against, in this example, the concrete wall. Next, an electromagnetic pulse of energy from excitation source 42 travels between antenna plates 34A and 34B and inside the pyramid-shaped block 32 of dielectric material. The dielectric material of pyramid-shaped block 32 is selected such that the dielectric constant $\epsilon_R$ of the dielectric material approximates the dielectric constant $\epsilon_R$ of the concrete. Thus, the pulse travels from base 44 of antenna 30 into the volume without any substantial change in dielectric constant $\epsilon_R$ from antenna 30 to the concrete.

The relatively unchanged dielectric constant $\epsilon_R$from antenna 30 to the concrete greatly reduces any ringing or first surface interface reflections of the pulse. Of course, other dielectric materials may be selected based on the dielectric constant of the volume containing the object to be imaged. For example, pyramid-shaped block 32 may be formed of a dielectric material having a dielectric constant $\epsilon_R$ approximately equal to the dielectric constant $\epsilon_R$ of any one of concrete, asphalt, soil, wood, stone, tile, or sheetrock. In one embodiment, pyramid-shaped block 32 is removable, and may be substituted for another block 32 with a different dielectric constant $\epsilon_R$.

The dielectric material of pyramid-shaped block 32 is e.g. a machinable, castable, or moldable microwave dielectric material that has a low loss tangent over the frequency range of interest (e.g., 2 GHz). One such material is a machinable dielectric material commercially available from Trans-Tech, Inc. of Adamstown, Md., as part number SMAT-10. A similar material is available from Cumings Corporation of Avon, Mass., as part number AK-10. These dielectric materials have dielectric constants $\epsilon_R$ of 10, which is approximately equal to that of concrete. Pyramid-shaped block 32 may also be formed of the same material as the volume within or behind which objects are to be detected (e.g., block 32 may be formed of wood or concrete).

Figure 4:
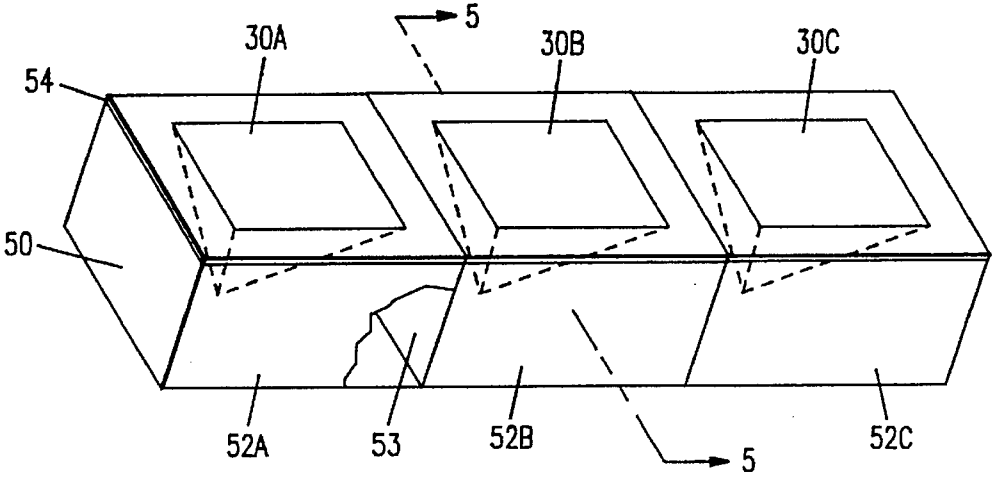
FIG. 4 shows an antenna enclosure 50 that contains three antennas (30A, 30B, and 30C).

FIG. 4 shows an antenna enclosure 50 that contains three antennas (30A, 30B, and 30C), each of which is similar to antenna 30 of FIGS. 2 and 3. Antennas 30A, 30B, and 30C are arranged such that the base of each pyramid-shaped block of dielectric faces substantially the same direction. Each antenna in the array is enclosed in a separate metal compartment (52A, 52B, and 52C) to reduce cross-talk interference between adjacent antennas. Each of compartments 52A, 52B, and 52C is separated from adjacent compartments by conductive dividers, such as divider 53 shown in the cut-away portion of FIG. 4. Interference is further reduced by providing a ferrite-loaded lossy gasket 54 across the face of enclosure 50, the gasket 54 defining holes through which the base of each antenna is exposed. Thus configured, the gasket surface and exposed bases of each antenna may be placed against a solid volume to locate objects within or behind the volume.

Figure 5:
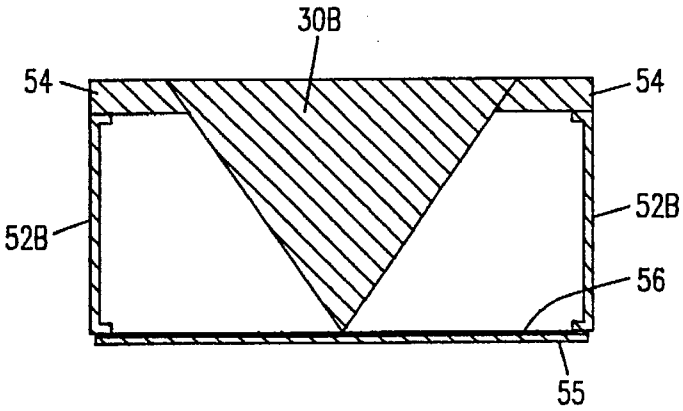
FIG. 5 shows a cut-away view of antenna enclosure 50 from perspective 5—5 of FIG. 4.

FIG. 5 shows a cut-away view of antenna enclosure 50 from perspective 5—5 of FIG. 4. In FIG. 5, a printed circuit board 55 is shown mounted to antenna enclosure 50. Printed circuit board 55 provides electrical contacts for antennas 30A, 30B, and 30C, and includes a ground plane 56 that further aids in reducing cross-talk interference between antennas 30A, 30B, and 30C.

An antenna enclosure including three antennas in accordance with this embodiment may be used, for example, in conjunction with the device disclosed in the copending application entitled "Dual Transmitter Visual Display System," which requires multiple antennas.

Although the present invention has been described in considerable detail with reference to certain preferred versions, other versions are possible. For example, conventional nondirectional antennas, such as log-spiral antennas, or conventional directional antennas, such as log-periodic antennas, may be embedded in dielectric material. However, in embodiments that use nondirectional antennas, an electromagnetic-energy absorbing barrier, e.g., a ferrite-loaded lossy gasket, should be placed between the antenna and the remaining electrical components of the radar system to reduce noise. Other examples include directional horn antennas or parabolic reflectors with log-periodic feeds, both of which antenna configurations include a cavity in their respective signal paths that may be completely filed with dielectric material. Therefore, the spirit and scope of the appended claims should not be limited to the description of the preferred versions contained herein.

What is claimed is:

1. A pyramidal horn antenna for transmitting or receiving electromagnetic signals into or from a surface, the antenna comprising:

a pyramid formed of a solid dielectric material, the pyramid including a rectangular base and four triangular sides, the four sides defining four planes that extend from the base to meet at an apex of the pyramid; and first and second triangular plates, each of the plates formed of a conductive material, the first plate overlaying and in contact with one of two opposite ones of the four sides, the second triangular plate overlaying and in contact with the other of the two opposite ones of the four sides;

wherein length of to first and second triangular plates substantially covers the respective opposite ones of the four sides: and wherein the pyramid and the first and second triangular plates reduce ringing associated with transmitting electromagnetic signals into the surface.

2. The antenna of claim 1, wherein the pyramid is formed of a dielectric material having a dielectric constant $\epsilon_R$ of approximately 10.

3. The antenna of claim 1, wherein the angle between the first and second plates is approximately 53°.

4. The antenna of claim 3, wherein the rectangular base includes two opposite edges approximately 1.75 inches in length and two opposite edges approximately 1.5 inches in length, and wherein the first and second triangular plates extend toward the apex from the two opposite edges approximately 1.75 inches in length.

5. The antenna of claim 1, wherein the conductive material includes copper.

6. The antenna of claim 1, wherein the conductive material includes silver.

7. An antenna system for transmitting and receiving electromagnetic signals into or from surface, the system comprising:

an enclosure having a plurality of chambers; and a plurality of pyramidal horn antennas, wherein each of the antennas is contained in a corresponding one of the chambers, each of the antennas including:

a pyramid formed of a solid dielectric material, the pyramid including a rectangular base and four triangular sides, the four sides defining four planes that extend from the base to meet at an apex of the pyramid; and first and second triangular plates, each of the plates formed of a conductive material, the first overlaying and in contact with one of two opposite ones of the four sides, the second triangular plate overlying and in contact with the other of the two opposite ones of the four sides;

wherein each of the first and second triangular plates substantially covers the respective opposite ones of the four sides; and wherein the pyramid and the first and second triangular plates reduce ringing associated with transmitting electromagnetic signal into the surface.

8. An antenna system for transmitting and receiving electromagnetic signals through a solid volume to locate objects within the volume, the system comprising:

an enclosure defining a plurality of chambers, the enclosure having a face configured to abut the solid volume; and a plurality of pyramidal horn antennas, wherein each of the antennas is contained in a corresponding one of the chambers, each of the antennas including:

a pyramid formed of a solid dielectric material, the pyramid including a rectangular base and four triangular sides, the four sides defining four planes that extend from the base to meet at an apex of the pyramid; and first and second triangular plates, each of the plates formed of a conductive material;

wherein the face of the enclosure includes a lossy gasket having holes through which the base of each of the antennas is exposed to the solid volume.

9. The antenna system of claim 8, wherein each pyramid is formed of a dielectric material having a dielectric constant $\epsilon_R$ of approximately 10.

10. The antenna system of claim 8, wherein the first and second triangular plates of each antenna have an angle between them of approximately 53°.

11. The antenna of claim 10, wherein each rectangular base includes two opposite edges approximately 1.75 inches in length and two opposite edges approximately 1.5 inches in length, and wherein the first and second triangular plates extend toward the apex from the two opposite edges approximately 1.75 inches in length.

12. The antenna of claim 8, wherein the conductive material includes copper.

13. The antenna of claim 8, wherein the conductive material includes silver.

* * * * *